US005879020A

United States Patent [19]

Buquet

[11] Patent Number: 5,879,020

[45] Date of Patent: Mar. 9, 1999

[54] BINDING PART FOR SKIS, HEEL-BINDING OR TOE-PIECE

[75] Inventor: Thierry Buquet, Varennes Vauzelles, France

[73] Assignee: Look Fixations S.A., France

[21] Appl. No.: 691,666

[22] Filed: Aug. 2, 1996

[30] Foreign Application Priority Data

Aug. 9, 1995 [FR] France ..... 95 09806

[51] Int. Cl.[6] ..... A63C 9/08

[52] U.S. Cl. ..... 280/633; 280/634

[58] Field of Search ..... 280/617, 618, 280/631, 632, 633, 634

[56] References Cited

U.S. PATENT DOCUMENTS

| | | | |
|---|---|---|---|
| 3,489,122 | 1/1970 | Schweizer et al. | 280/634 |
| 3,990,724 | 11/1976 | Schweizer et al. | 280/632 |
| 4,103,930 | 8/1978 | Valoh | 280/631 |
| 4,519,624 | 5/1985 | Bressand et al. | 280/633 |
| 4,589,674 | 5/1986 | Krob et al. | 280/633 |
| 5,575,496 | 11/1996 | Luitz et al. | 280/618 |

FOREIGN PATENT DOCUMENTS

| | | |
|---|---|---|
| 546 260 | 6/1993 | European Pat. Off. . |
| 2 437 226 | 4/1980 | France . |

*Primary Examiner*—Brian L. Johnson
*Assistant Examiner*—Frank Vanaman
*Attorney, Agent, or Firm*—John Kurucz; John Moetteli; Bugnion S.A.

[57] ABSTRACT

Binding part comprising a fitted body (1) sliding along a support (2) fixed to the ski and pushing in the direction of the middle of the binding with the aid of a drive spring (11) supported against a bolt (19) and intended to keep the boot, through its compression, cramped between the front toe-piece and the heel binding. It comprises a visual check display of the compression of the drive spring, comprising an arm (24) connected kinematically to the mainstay (19) and a window (26) on the upper side or lateral side of said body in which said arm appears, preferably only in the event of the correct adjustment of the binding.

6 Claims, 5 Drawing Sheets

FIG.1
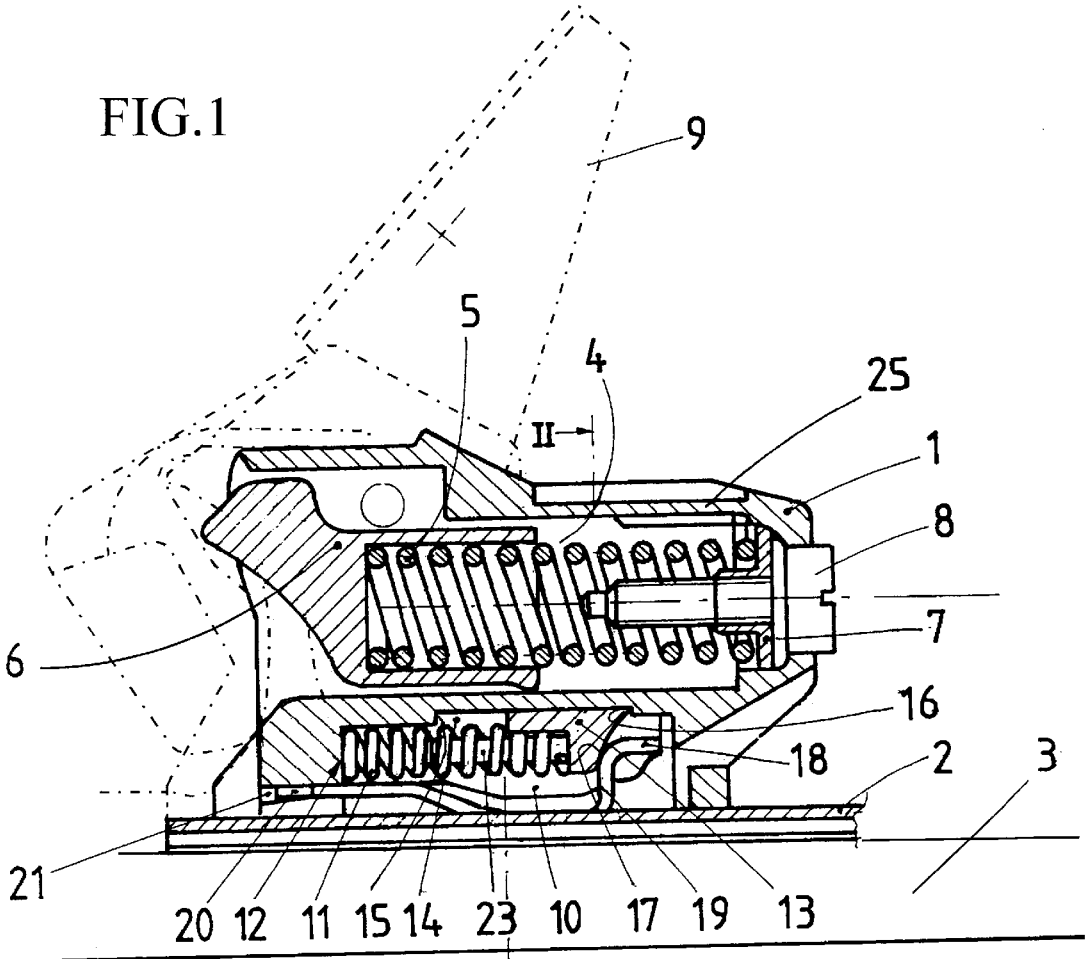
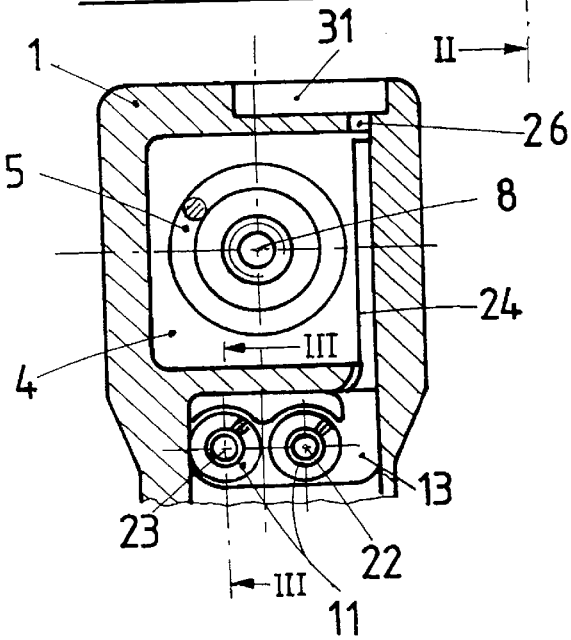
FIG.2
FIG.3
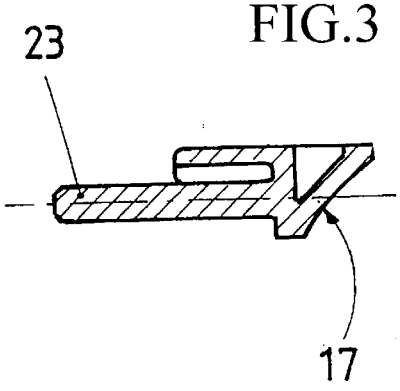

BINDING PART FOR SKIS, HEEL-BINDING OR TOE-PIECE

FIELD OF THE INVENTION

The object of this invention is a binding part for skis, heel-binding or toe-piece, comprising a fitted body sliding on a support fixed to the ski and pushing in the direction of the middle of the binding with the aid of a drive spring supported against a mainstay locked on the support and intended to keep the boot, through its compression, cramped between the front toe-piece and the heel binding. It comprises a visual check display of the compression of the drive spring.

PRIOR ART

In order to ensure that the boot is correctly fitted between the toe-piece and heel bindings, the heel binding is generally fitted to its support flexibly by means of a drive spring so that when the boot is secured in the binding, it pushes back the heel-binding, using the support of the fixed front toe-piece, by compressing the drive spring. The drive spring must not be over or under compressed in order to ensure the firm securing of the boot whilst maintaining a certain flexibility on the binding which may be required to ensure a lateral release in the event of a fall and to absorb the variation in distance between the heel and toe-piece bindings when the ski bends. In order to ensure that the heel-binding is positioned satisfactorily and that the drive spring is correctly compressed when the boot is fitted, the heel-bindings comprise an indicator showing the correct position of the toe-piece for the drive spring. Some heel-bindings simply have a gauge on the body side of the heel (FR 2 437 226). There is also a Tyrolia-type binding where the body has a lateral window through which the drive spring toe-piece position can be seen. In general, in all cases, gauging the compression of the drive spring is done on the heel side. These methods of viewing the compression of the drive spring are intended for specialists, particularly retailers. The user himself may, however, need to re-adjust the drive spring, for example, in the event of a change of boot-size. This user often has difficulty in viewing the compression of the drive spring. Moreover, a user who is not aware of the problems involved in re-adjustment, runs the risk of making an inappropriate adjustment if they adjust the drive-spring position with the heel position open.

SUMMARY OF THE INVENTION

The aim of the invention is to facilitate the view of the drive-spring compression level and, in the case of the heel binding, to prevent an inappropriate adjustment of this compression.

The binding part according to the invention is characterised by the fact that the means of viewing the drive-spring compression level comprises an arm connected kinematically to the support piece and extending upwards and a window on a lateral side of the afore-mentioned body in which the above-mentioned arm appears, preferably in the event of the correct adjustment of the binding.

There is also a display of the drive-spring compression level which enables the possibility of ensuring that the adjustment of the position of the adjustable binding part in relation to the other part of the binding is such that it guarantees the correct release of the binding.

Moreover, in the case of heel bindings fitted with a manual release lever covering the upper side of the body of the heel with the heel-binding in the open position, as is generally the case, the display of the drive spring compression level is masked with the heel-binding in the open position, in such a way that it is a significant means of fitting the boot and closing the binding in order to make this adjustment.

In the case where the display is on one lateral side of the body of the heel-binding, the manual release lever may be fitted with a guard which covers the display in the open position.

The window is preferably provided for alongside the window provided for the display of the release spring compression level, both windows thus being combined in a sort of display panel which is only visible when the heel-binding is in the closed position. The adjustment of the release spring compression level should, preferably, only be carried out with the heel-binding in the closed position, the release spring being compressed to a maximum when the heel-binding is in the open position.

The invention can clearly be applied equally effectively both to a stage-by-stage adjustable binding body on a notched sliding scale, as described, for example, in patents FR 2 451 756 and FR 2 614 545, and to a body which can be continuously adjusted with the aid of a screw, detachable or otherwise, as described, for example, in patent application EP 0 641 576.

BRIEF DESCRIPTION OF THE DRAWINGS

The drawing represents, by way of example, one embodiment of the invention.

FIG. 1 is an axial cutaway view of a heel-binding in the open position, without the boot.

FIG. 2 is a cutaway view in accordance with II—II of FIG. 1.

FIG. 3 is a partial cutaway view in accordance with III—III of document 13, FIG. 2.

DESCRIPTION OF THE PREFERRED EMBODIMENT(S)

Figure 4:
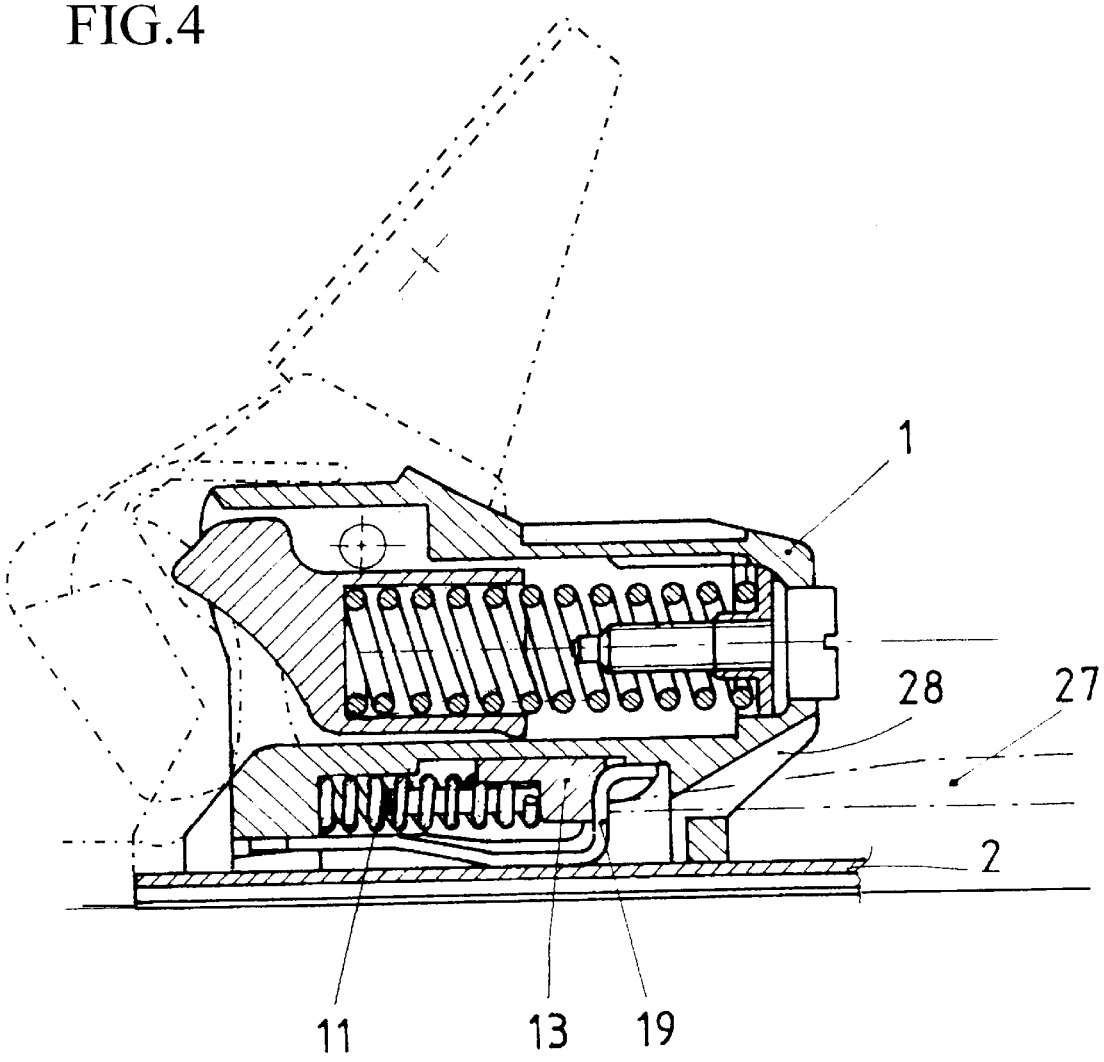
FIG. 4 is a similar view to FIG. 1 illustrating the process of the adjustment of the heel-binding position.

The heel-binding represented in FIG. 1 comprises a body 1 fitted to a sliding rail 2 itself fitted to a ski 3. In its central section, the body 1 offers a housing section 4 extending axially on to the body and covering, in standard fashion, a release spring 5 compressed between a piston 6 and a nut 7 which can be adjusted using a screw 8. The piston 6 forms part of the trigger-release mechanism represented by fine lines and comprises, in particular, a manual release lever 9 and a clamp 29 intended to hold the boot by its heel.

In its lower section, the body 1 has a cavity 10 which opens downwards and in which two drive springs 11 (also called return springs) are fitted, side by side, and operating subject to compression between a front wall 12 of the cavity 10 and a moveable slide-bar 13 mounted on a groove 14 limited by two cross-walls 15 and 16. The slide-bar 13 is supported by a rail 17, at around 45°, against a curved section 18 of a bolt 19 comprising a cut-off elbowed metal plate, fitted with at least one tooth on each side, these teeth being engaged in one of the notches provided for on the sliding rail 2 on both internal sides of this sliding rail. The drive spring 11 also serves to hold the bolt 19 in the secured position. The bolt 19 is extended forwards through a T-section 20 located in a housing section 21 of the body 1.

The slide-rail 13 has two parallel rods 22 and 23 located respectively in each of the drive springs 11 and, on the side, an arm 24 which extends across the heel-binding to the upper wall 25 of the body 1. In this wall 25, a narrow window 26 has been cut out and is aligned, longitudinally on the end of the arm 24.

FIG. 1 represents the heel-binding in the open position but without the boot. In this position, no external force is acting on the heel-binding and the body 1 of the heel-binding is pressed against the T end 20 of bolt 19 through the effect of the drive spring 11. The arm 24 is in the furthest position it can go back in relation to the body 1 of the heel-binding and does not appear in the window 26.

In order to adjust the position of the heel-binding in relation to the toe-piece of the binding, start by positioning the heel-binding approximately, moving it, if necessary, along the sliding rail 2. To this end, the heel-binding is released by removing the bolt 19 through the curved section 18 with a screwdriver 27 introduced into the housing section 10 through an aperture 28 provided for this purpose (FIG. 4). It is then possible to move the heel-binding along the sliding rail. On removing the screwdriver 27, the drive springs 11 re-lock the heel-binding on the sliding rail 2.

Figure 5:
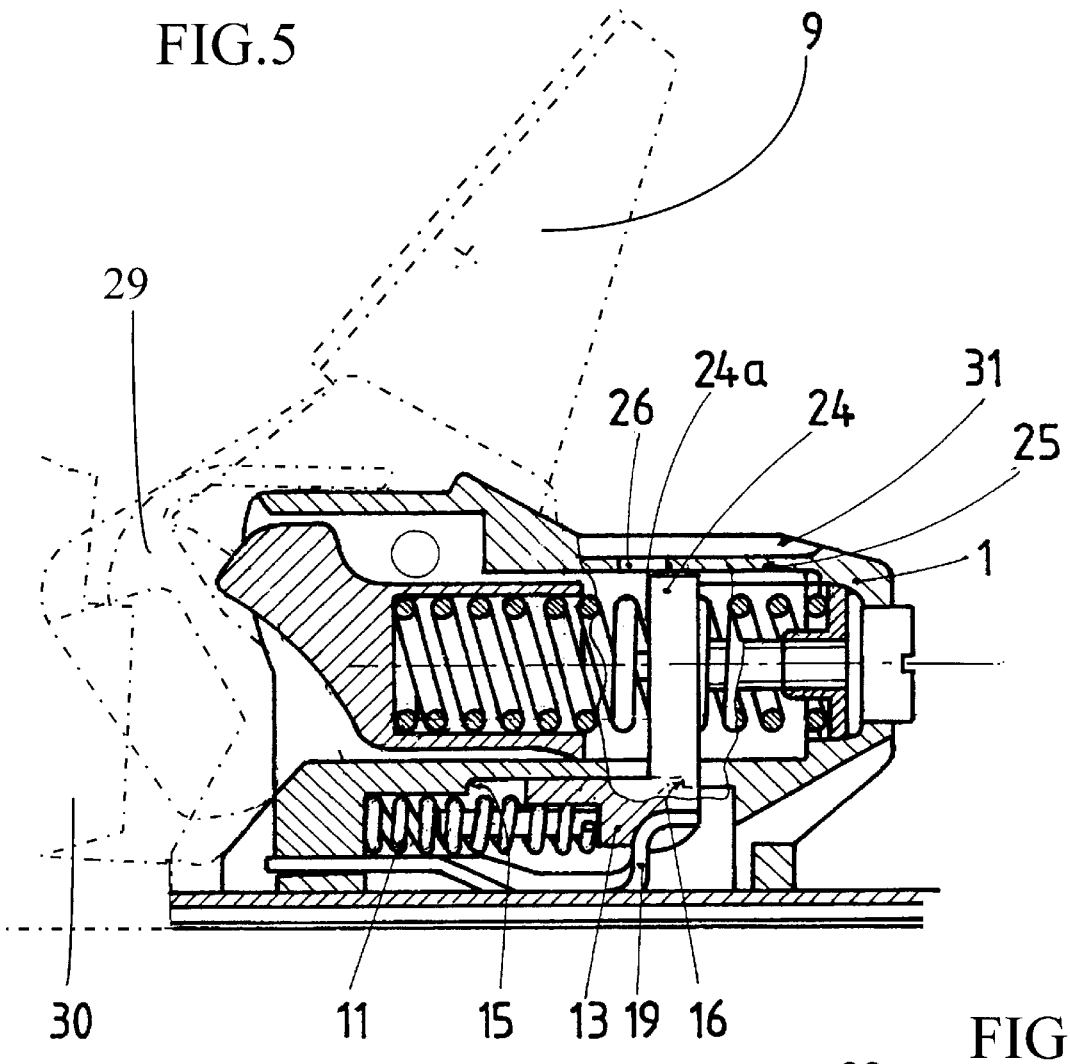
FIG. 5 is a cutaway view in accordance with V—V of FIG. 6.

The boot can then be secured in its binding, as represented in FIG. 5, the clamp or heel-grip 29 being supported on the heel 30 of the boot. If the heel-binding is correctly positioned, it is forced backwards compressing the drive springs 11 so that the arm 24 appears in the window 26. For correct positioning, the front edge 24*a* at the end of the arm 24 must appear between the two sides of the window 26, between two gauge markers. In this position, the drive springs 11 are compressed so as to keep the boot cramped between the toe-piece and the heel-binding whilst allowing the heel-binding to move flexibly both forwards and backwards.

With the heel-binding in the open position, the manual release lever 9 is pushed downwards on to the body 1 so that it covers the window 26. It is therefore not possible to see the arm 24 in this open position which is what is required since, in the open position or without a boot, any adjustment is of little significance given that the arm 24 is behind the window 26.

The upper wall 25 of the body 1 forms the base of a hollow 31 intended to receive a transparent platelet. This hollow has a second window 32 which extends at an oblique angle in relation to the axis of the adjustment screw 8, this window 32 being intended for the display of the pre-compression level of release spring 5. A sort of display panel is thus obtained where the adjustment of the tension of the release spring and the correct adjustment of the heel-binding position can be read simultaneously at a glance.

Figure 7:
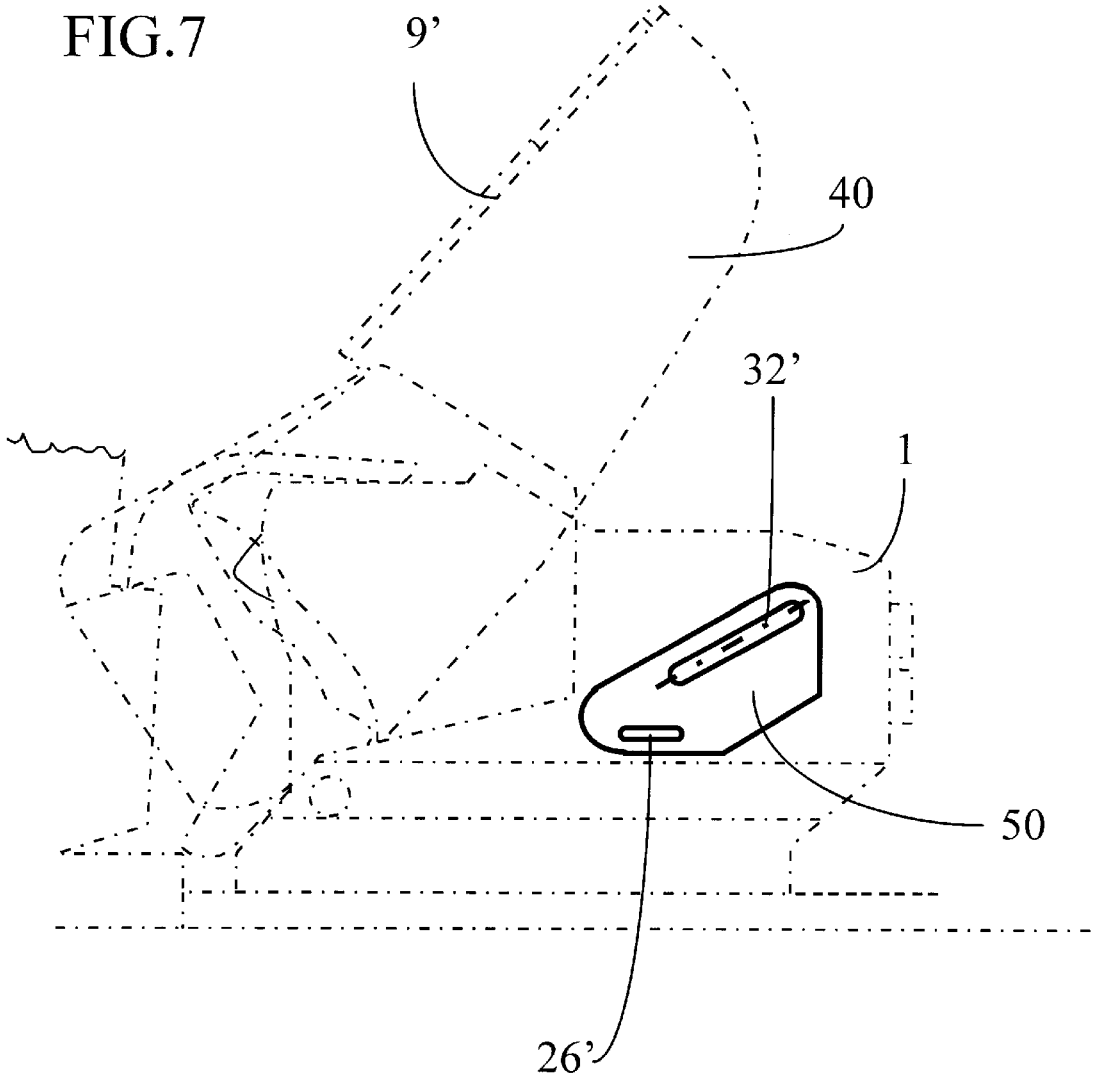
FIG. 7 represents a side-display alternative embodiment.

FIG. 7 represents a variant of the heel-binding embodiment described above where the display 50 of the tension and correct adjustment of position is situated on a lateral side of the body of the heel-binding. The respective windows are designated 32' and 26'. Alongside this lateral side, the manual release lever 9' has a wider guard 40 to cover the display 50 in the open position.

The arm 24 can of course adopt another shape. It may, specifically, be curved or even in the shape of a bow.

Instead of being dependent on an intermediate part such as the slide-bar 13, the drive spring compression indicator arm may be dependent on the bolt, particularly where the drive spring is supported directly against the bolt, for example, in the case of bindings such as those described in patents FR 2 368 974 and FR 2 451 756.

Figure 8:
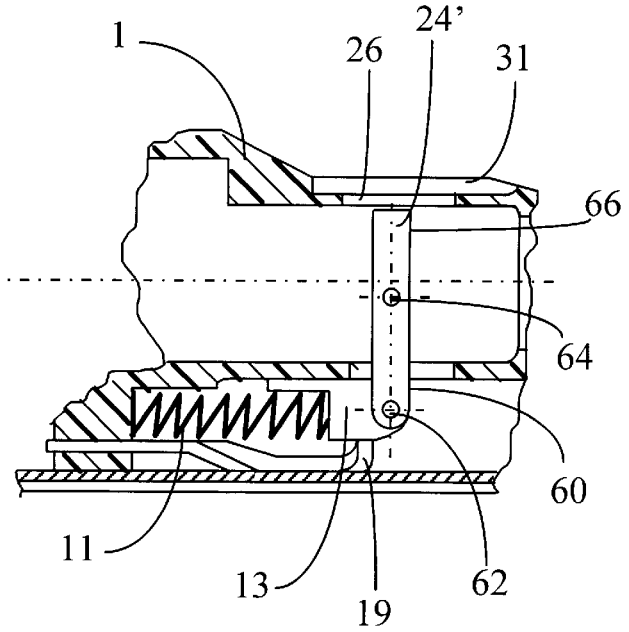
FIG. 8 represents a cut-away view of an alternate embodiment.
Figure 9:
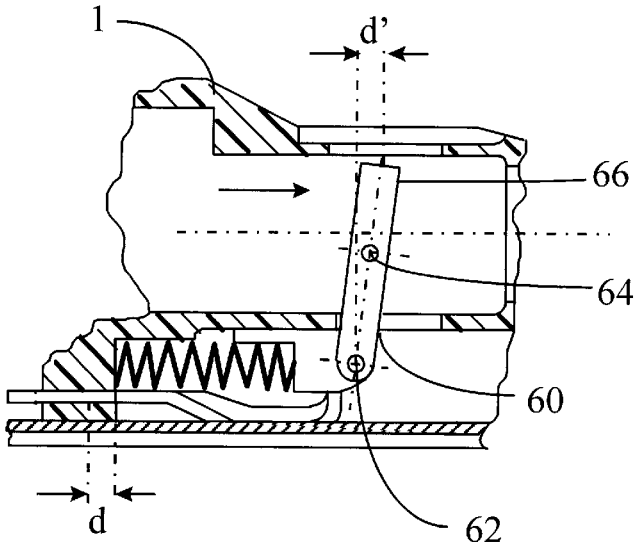
FIG. 9 represents a cut-away view of an alternate embodiment.

The arm 24 may be joined at one end to the slide-bar or the bolt at an intermediate point on the body of the heel-binding so as to attain, at the other end of the arm, either an extension of the movement of the heel-binding, thus increasing the accuracy of the adjustment, or a reduction in the movement, thus enabling a broader adjustment as shown in FIGS. 8 and 9.

In FIGS. 8 and 9, an arm 24' pivots on a pivot point 64 located at an intermediate point on the body 1 in order to cause a displacement d of the body 1 with respect to a fixed pivot point 62 during articulation. This articulation amplifies the movement about the free end 66 of the arm by an amount d'.

Figure 10:
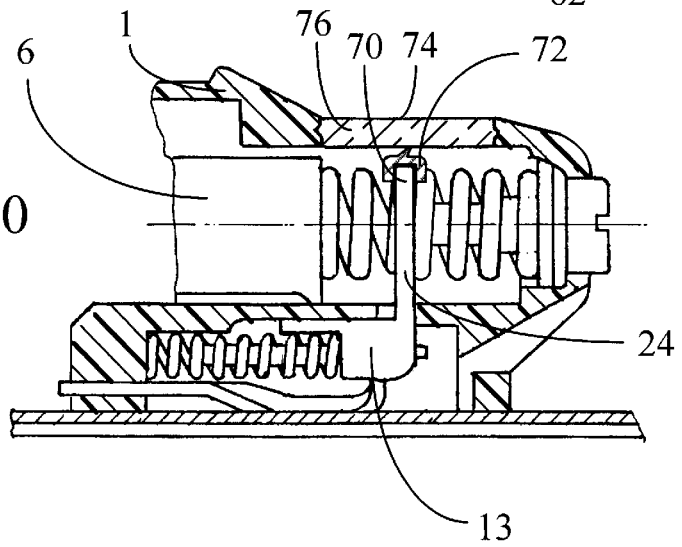
FIG. 10 represents a cut-away view of an alternate embodiment of the invention represented in FIG. 5.

Referring now to FIG. 10, showing a variant of the invention as disclosed in FIG. 5, an end 70 of the arm 24 can be fitted with a flexible material 72 supported against a transparent screen 74 and which closes the window 26 so as to remove mist through frictional contact with the screen.

Figure 6:
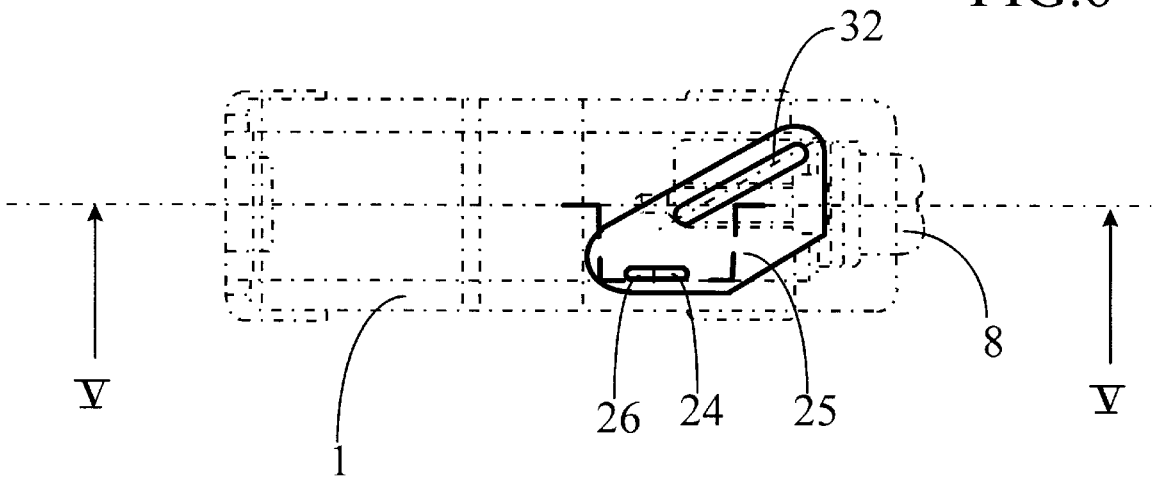
FIG. 6 is an top view of the heel-binding represented in FIG. 5, without the manual release lever.

As a variant, the body 1 may have a large opening, on top or on the side, closed by a transparent plastic plate 76 decorated so that it only shows the transparent parts corresponding to the windows 26 and 32 (shown more clearly in FIG. 6).

I claim:

1. A binding for a ski, comprising a body (1) mounted longitudinally sliding on a support (2) adapted to be fixed to the ski and the body being biased by a drive spring (11) adapted to be compressed and resting against a support bolt (19) fixed to said support (2) and intended to maintain through its compression a boot cramped between a front toe-piece and a heel binding, and further comprising visual check display means for checking the compression of said drive spring, characterized in that said visual check display means includes an arm (24) kinematically linked to said support bolt (19) and extending upwards and by a window (26) on the upper side or on a lateral side of said body (1) in which said arm appears, said support bolt (19) maintaining said body in position on said support (2) and comprising an intermediate piece (13) between said drive spring (11) and said bolt (19), characterized in that said arm (24) is fixed to said intermediate piece (13).

2. A Binding according to claim 1, in which said body (1) has on its upper side (25) or on its lateral side a display (32) for displaying the compression level of said drive spring, characterized in that said window (26) is placed next to said display (32).

3. A binding as claimed in claim 2, comprising a manual voluntary opening lever (9) for said heel-binding covering at least the upper side of said body when said heel-binding is in an open position characterized in that in said open position, the voluntary opening lever masks said display (32) and said window (26).

4. A binding as claimed in claim 1, characterized in that said arm has a free end (66) and a pivoting end (60) fixed to the support (2), and a pivot point (64) at an intermediate point on the arm upon which pivot point the body articulates, in order to magnify the displacement of the free end of said arm.

5. A binding as claimed in claim 1, characterized in that said window is closed by a small transparent plate and said arm is provided with a flexible material bearing against said small plate and rubbing against said small plate during the movement of said arm.

6. A binding as claimed in claim 1, characterized in that said body (1) has a display which comprises a broad window (26) closed by a transparent plastic material plate (74) fitted with a decor leaving only one transparent area on said window and a second window (32) for displaying the compression level of the drive spring.

* * * * *